US007938697B2

(12) United States Patent
Inaba et al.

(10) Patent No.: US 7,938,697 B2
(45) Date of Patent: May 10, 2011

(54) TORSION-STYLE CONNECTOR

(75) Inventors: Kenji Inaba, Kanagawa (JP); Kazushige Asakawa, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/520,197

(22) PCT Filed: Dec. 19, 2007

(86) PCT No.: PCT/US2007/025948
§ 371 (c)(1),
(2), (4) Date: Jan. 18, 2010

(87) PCT Pub. No.: WO2008/082560
PCT Pub. Date: Jul. 10, 2008

(65) Prior Publication Data

US 2010/0136850 A1 Jun. 3, 2010

(30) Foreign Application Priority Data

Dec. 19, 2006 (JP) ..... 2006-341033

(51) Int. Cl.
*H01R 4/48* (2006.01)

(52) U.S. Cl. ..... 439/862; 439/500; 439/289

(58) Field of Classification Search ..... 439/862, 439/289, 500, 660
See application file for complete search history.

(56) References Cited

U.S. PATENT DOCUMENTS

| | | | | |
|---|---|---|---|---|
| 4,536,055 | A * | 8/1985 | Kandybowski et al. | 439/862 |
| 5,857,857 | A * | 1/1999 | Fukuda | 439/188 |
| 5,885,118 | A * | 3/1999 | Billenstein et al. | 439/862 |
| 6,200,151 | B1 | 3/2001 | Kaneko | |
| 6,794,890 | B1 | 9/2004 | Tokumo et al. | |
| 6,893,300 | B2 * | 5/2005 | Zhou et al. | 439/862 |
| 7,029,287 | B2 | 4/2006 | Matsunaga et al. | |
| 7,098,857 | B2 | 8/2006 | Zoller et al. | |

OTHER PUBLICATIONS

International Search Report and Written Opinion of PCT Patent Application No. PCT/US2007/0025948. Apr. 17, 2008.

* cited by examiner

*Primary Examiner* — Hien Vu
(74) *Attorney, Agent, or Firm* — Timothy M. Morella

(57) ABSTRACT

A terminal (51) utilizes a torsional spring as its contact portion. The terminal is formed form a plate of sheet metal and first (52), second (53) and third (54) members are defined by two spaced apart slits formed in the plate. The members are formed in circular arcs and the first member has a free end that is extended out and away from of the arc and bent into a general U-shape to define the contact portion. The remainder of the plate serves as a base portion (57) for attaching the terminal to a connector or circuit board.

11 Claims, 7 Drawing Sheets

PRIOR ART

TORSION-STYLE CONNECTOR

BACKGROUND OF THE INVENTION

The present invention relates generally to a battery connector and terminal therefor and more specifically to a torsion-coil style battery connector.

FIG. 7 is a perspective view illustrating a conventional battery connector terminal.

As shown in FIG. 7, the terminal is fabricated by stamping and bending a metal sheet, and includes a flat base 801, a pair of first spring portions 802 and 803 connected to one side of the base 801, and a second spring portion 804 connected to the free ends of the first spring portions 802 and 803 and bent so that the second spring portion 804 projects toward the front. The second spring portion 804 is connected to the first spring portions 802, 803 via interconnecting plate portion 806 which connects the free ends of the first spring portions 802 and 803 together. In the vicinity of the free end of the second spring portion 804, a contact portion 805 is formed which contacts an opposite-side terminal such as an electrode of a battery. By elastic deformation of the first spring portions 802, 803 and the second spring portion 804, the contact portion 805 is pressed against the battery terminal.

In this type of conventional terminal described above, larger portions of the first spring portions 802, 803 and the second spring portion 804 remain straight, and the curved portions thereof are short. The length of elastically deformable portions is insufficient, and thus flexibility is low, and the contact portion 805 cannot be displaced greatly towards the interconnecting plate portion (in the horizontal direction) when the contact portion 805 presses against the battery terminal. The second spring portion 804 acts as a cantilever where the top end serves as a supporting point and the lower end serves as a free end, when the contact portion 805 contacts the battery terminal, the contact portion 805 is displaced largely horizontally. At the same time, the contact portion is largely displaced vertically. Therefore, when the battery terminal is small vertically, like a thin battery which is used for a thin cellular phone, the contact portion 805 contacts the contact surface of the battery terminal, which causes a failure in electrical conduction or charging, damages the body of the equipment or device equipped with the opposite-side terminal, or damages the contact portion 805 itself. Additionally, even though the thickness of the terminal can be reduced sufficiently to accommodate a thin battery, a space becomes necessary for absorbing the aforementioned displacement amount of the contact portion in the vertical direction, which does not contribute to a thickness reduction of electronic equipment and device.

SUMMARY OF THE INVENTION

It is therefore an object of the invention, by solving the problems of the conventional terminal, to provide a connector terminal and a connector in which a cylindrical portion is formed by rolling a thin and strip-shaped plate member which includes a long and slender strip-shaped first, second and third members which are connected to one end of the first member and parallel to each other, and a portion of the first member is located between the second member and the third member.

A contact portion is formed by bending the first member near the other end to have a shape protruding toward one side of the cylindrical portion, the cylindrical portion is deformed elastically, an amount of displacement of the contact portion is large in the horizontal direction but small in the vertical direction, ensuring that the contact portion contacts with the battery opposite-side terminal, and the space required for the battery terminal is small.

Therefore, a connector terminal according to the present invention includes a base attached to a connector, a cylindrical portion connected to the base, and a projecting portion projecting toward one side of the cylindrical portion includes a contact portion, wherein the cylindrical portion includes a strip-shaped first member and strip-shaped, second and third members connected to one end of the first member and parallel to each other, the first, second, and third member forming a continuous circular arc with an central angle of 360 degrees or more, a portion of the first member being located between the second and third members, and the projecting portion is constituted by a portion of the first member adjacent to an free end thereof.

In another embodiment of the connector terminal according to the present invention, the contact portion receives a biasing force exhibited by the opposite-side terminal and directed toward the cylindrical portion.

In a further embodiment of the connector terminal according to the present invention, the contact portion is displaced by an elastic deformation of the cylindrical portion when the contact portion receives a biasing force exhibited by the opposite-side terminal.

In a still further embodiment of the connector terminal according to the present invention, the contact portion is displaced toward the cylindrical portion.

In a yet further embodiment of the connector terminal according to the present invention, a straight line which indicates a direction of the biasing force that the contact portion receives from the opposite-side terminal is located closer to the base portion than to a central axis of the cylindrical portion.

In a further embodiment of the connector terminal according to the present invention, a straight line which indicates a direction of biasing force that the contact portion receives from the opposite-side terminal passes through a central axis of the cylindrical portion.

In a yet further embodiment of the connector terminal according to the present invention, the first member is located at a center of the connector terminal in a widthwise direction.

In a still further embodiment of the connector terminal according to the present invention, the first member, the second member, and the third member are connected integrally via an interconnecting portion, and have a shape of two-pronged fork before forming the circular arc of the terminal.

In a yet further embodiment of the connector terminal according to the present invention, the first member includes a slit formed therein extending longitudinally at least in the projecting portion, and the contact portion is divided in a width direction of the connector terminal.

A connector according to the present invention is provided with a connector terminal including a base attached to the connector, a cylindrical portion connected to the base, and a projecting portion projecting toward one side of the cylindrical portion which includes a contact portion, and a housing accommodating therein the connector terminal, wherein the cylindrical portion includes strip-shaped first member, second member and third member which are connected to one end of the first member and parallel to each other, the first member, the second member, and the third member forming a continuous circular arc with a central angle of 360 degrees or more, a portion of the first member is located between the first member and the third member, the projecting portion is constituted by a portion of the first member adjacent to a free end thereof, the housing includes an accommodating recessed portion for accommodating the connector terminal, and the accommodating recessed portion accommodates one, two or more connector terminals.

In another embodiment of the connector according to the present invention, the housing includes an open portion communicating with the accommodating recessed portion, and the contact portion projects from the open portion.

In a further embodiment of the connector according to the present invention, the contact portion is displaced elastically by the cylindrical portion when the contact portion receives a biasing force exhibited by the battery terminal, and the housing includes a terminal-receiving portion which contacts with the displaced contact portion.

According to the present invention, a connector terminal includes a cylindrical portion formed by rolling a strip-shaped plate member which includes a long slender strip-shaped first member, and long and slender strip-shaped second and third members which are connected to one end of the first member and parallel to each other so that a portion of the first member is located between the second and third members, and a contact portion which is formed by bending a portion of the first member adjacent to the other end thereof and has a shape protruding to one side of the cylindrical portion. Because of this, the cylindrical portion deforms elastically, and the amount of displacement of the contact portion is large horizontally but small vertically, thus ensuring that the contact portion comes into contact with the small opposite-side terminal. Further, a space exclusively occupied by the whole connector terminal can be small.

DESCRIPTION OF THE PREFERRED EMBODIMENT

Figure 1:
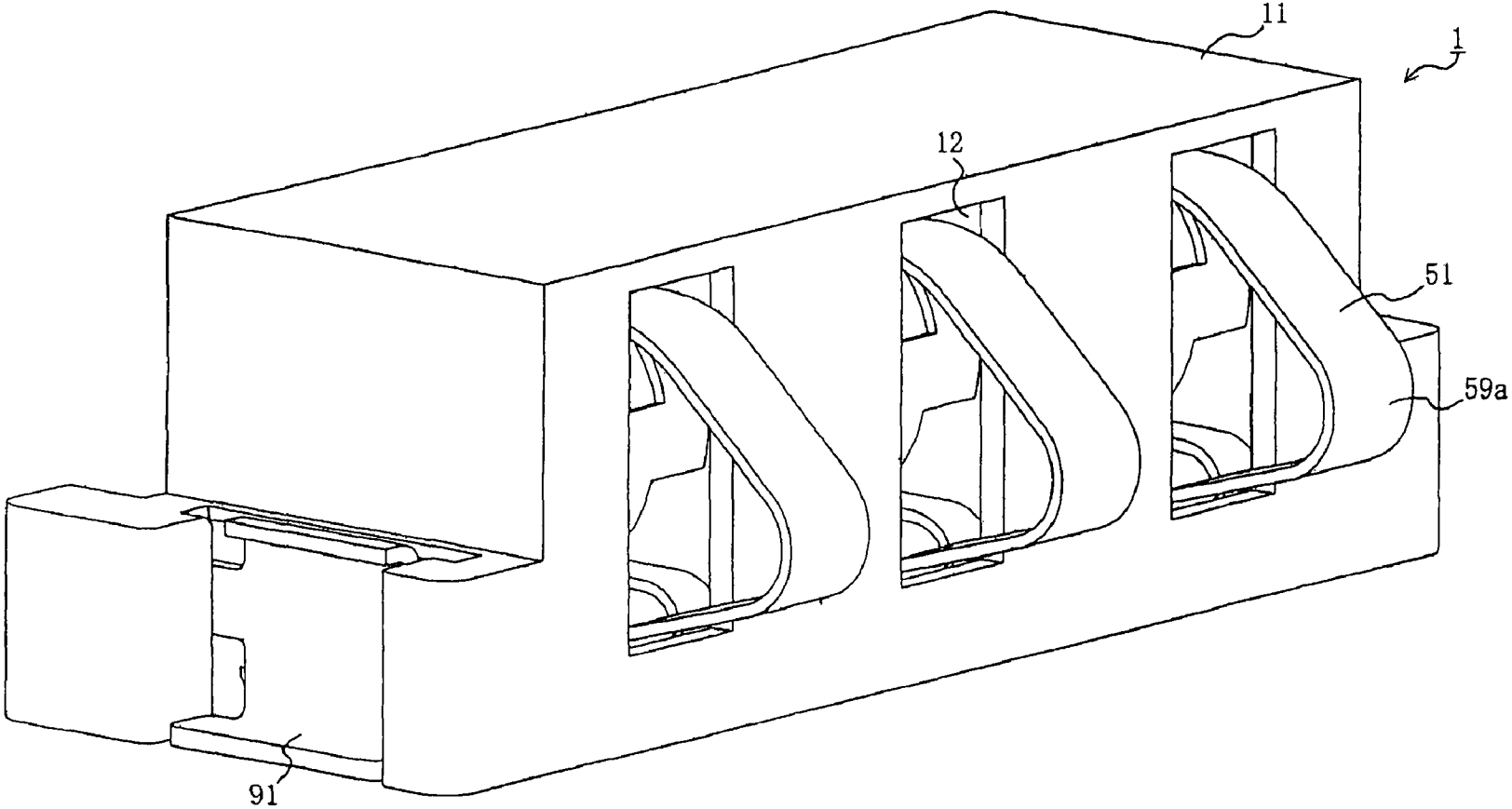
FIG. 1 is a perspective view of a connector according to an embodiment of the present invention.

A preferred embodiment of the present invention will be described below in detail with reference to the accompanying drawings.

In the drawings, reference numeral 1 represents a connector which is provided with a terminal 51 serving as a connector terminal in this embodiment, and the connector is attached to electronic equipment (not shown). The electronic equipment is mounted an opposite-side device 101 (such as a battery) via the connector 1 which connects to the electrical circuits of the electronic equipment. (FIG. 2)

The opposite-side device 101 described above may be any type of equipment as long as it can be mounted on an electronic equipment, and may be an electric connector, for example, but the opposite-side device 101 is described as a battery in this embodiment. In the drawings, the opposite-side device (battery) 101 includes a thin box-shaped body 111, and a one or more opposite-side terminals 151 exposed on one side of the body 111, and the battery is typically loaded in a thin cellular phone. In this case, the electric equipment to which the connector 1 is attached is the cellular phone or a battery charger for the cellular phone.

Figure 2:
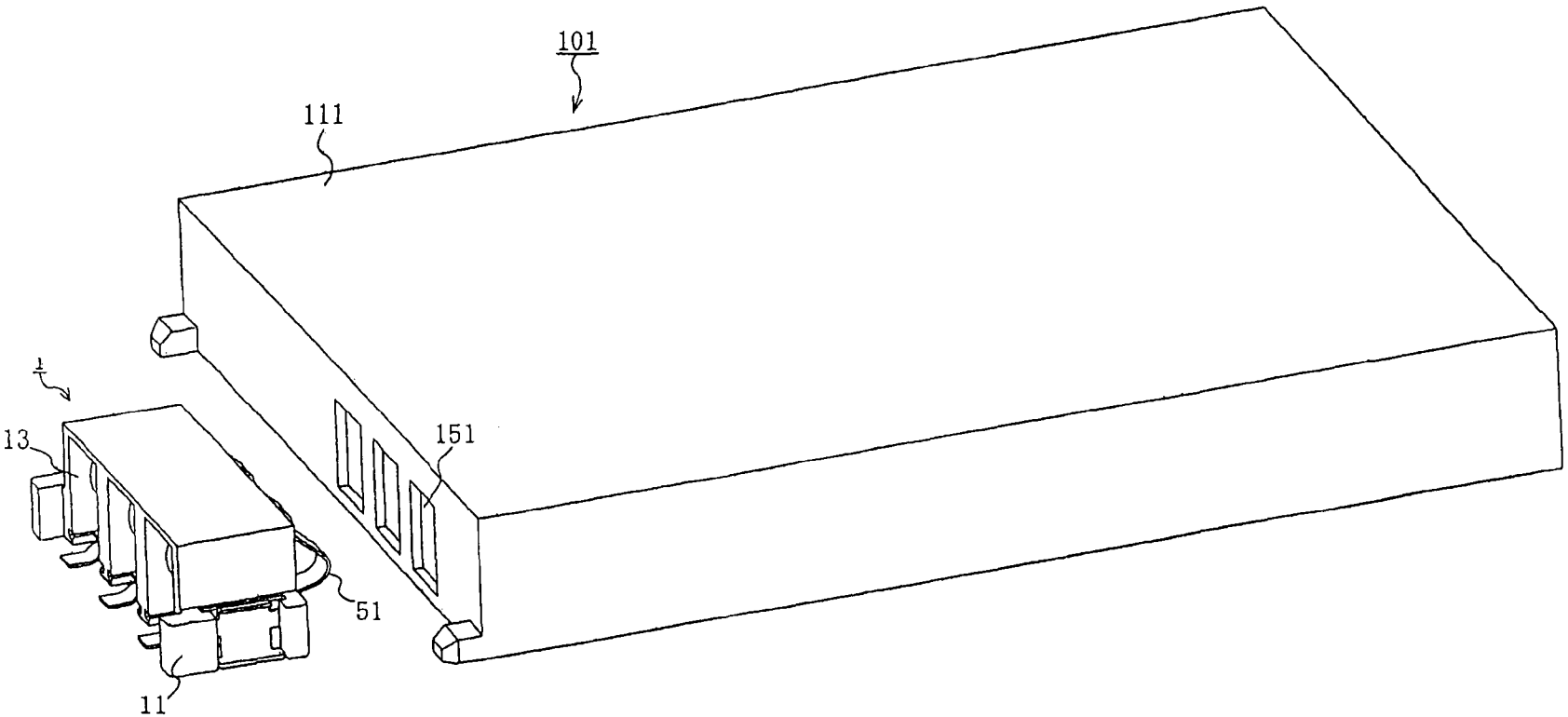
FIG. 2 is a perspective view illustrating a state where an opposite-side device is being fitted to the connector according to the embodiment of the present invention.

As shown in FIGS. 1 & 2, the connector 1 includes a housing 11 which is formed from an insulating material, and terminals 51, each of which is formed through the stamping and bending of a conductive material and are accommodated in an accommodating recessed portion 13, and has a contact portion 59*a* which projects outwards from an opening portion 12. Furthermore, an auxiliary mounting bracket 91, commonly known as a filling nail, is attached to both sides of the housing 11 for fixing the connector 1 to the electronic equipment.

Figure 3:
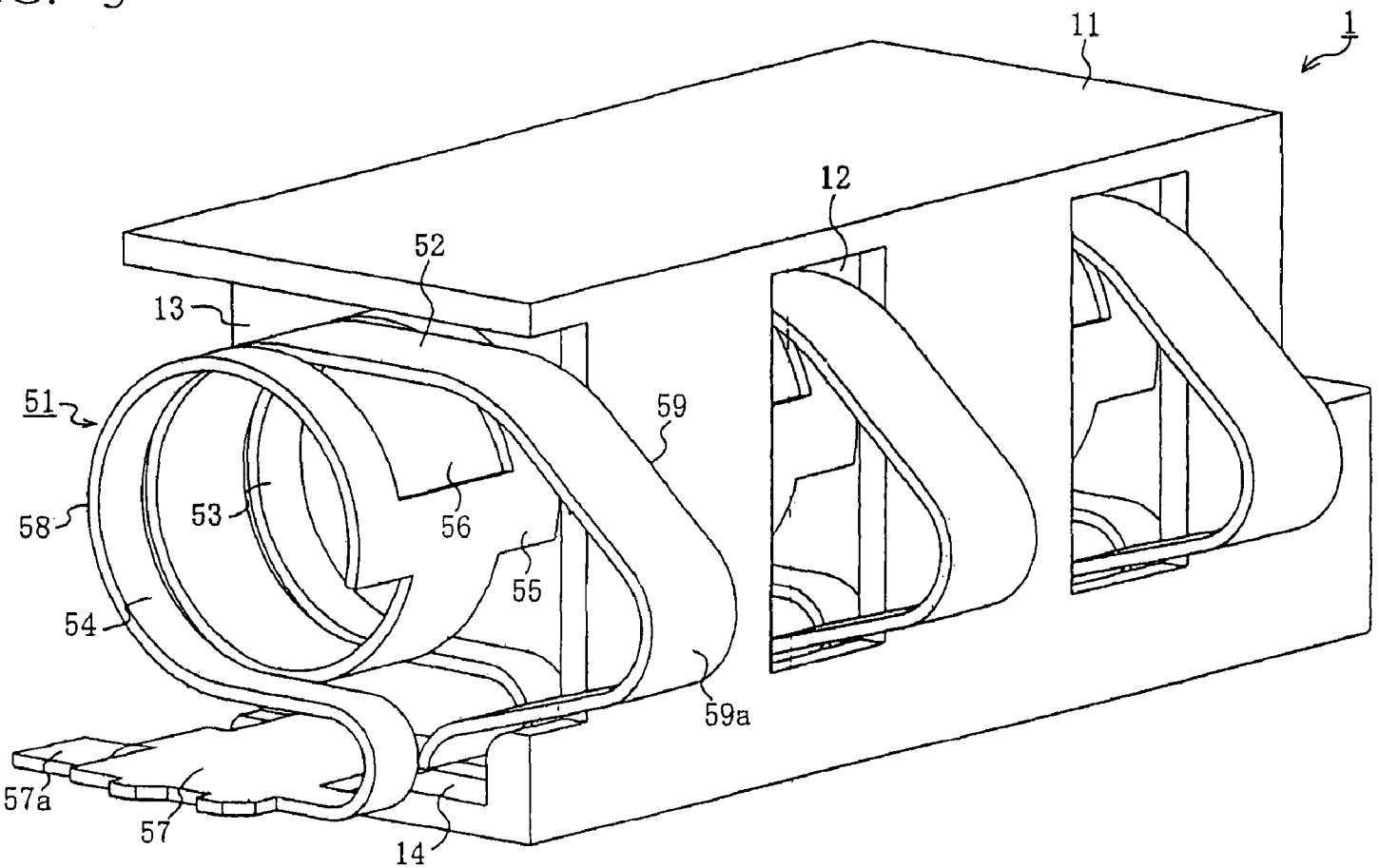
FIG. 3 is a cross-sectional view illustrating a main part of the connector.
Figure 4:
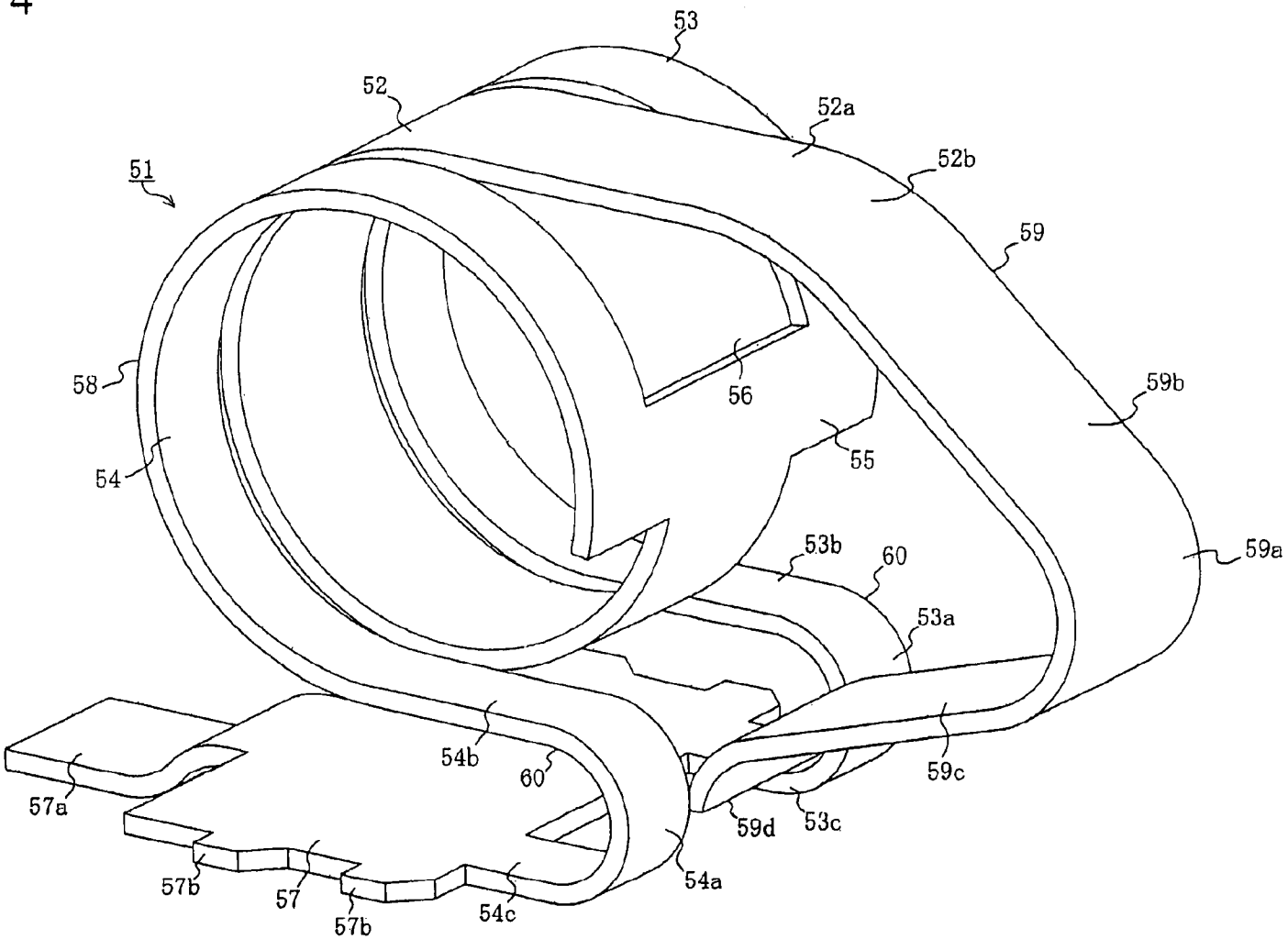
FIG. 4 is a perspective view of a terminal according to present invention.

FIG. 3 illustrates a main part of the connector according to the embodiment of the present invention, and FIG. 4 is a perspective view of a terminal.

As shown in FIG. 3, the housing 11 of the connector 1 includes three accommodating recessed portions 13 which are separate from each other, and the terminals 51 are accommodated in these portions 13, respectively. The contact portions 59*a* which contact the battery terminals 151 project outward from the opening portions 12, spatially communicating with the accommodating recessed portions 13. The number and location of accommodating recessed portions 13 may be appropriately determined, and it is not necessarily required that the terminals 51 are accommodated in all accommodating recessed portions 13. The housing 11 is provided with terminal receiving portions 14 which can receive projecting portions 59 when the terminals 51 receive a biasing force, respectively, from the opposite-side terminals 151 and are displaced.

Each of the terminals 51 is formed by a thin, long metallic plate which is formed in a predetermined shape by stamping.

As shown in FIG. 4, the terminal 51 includes a flat plate base 57, a cylindrical portion 58 located above the base portion 57, a projecting portion 59 connected to the cylindrical portion 58 which projects toward the side, and has an approximately triangular side shape, and an interconnecting portion 60 which interconnects the base 57 and the cylindrical portion 58 together. The cylindrical portion 58 includes a long and thin strip-shaped first member 52, and long and thin strip-shaped second and third members 53, 54 which are connected to one end of the first member 52 and are parallel to each other.

The first member 52, and the second and third members 53, 54 are integrally connected to each other via the interconnecting portion 55, and, prior to forming the cylindrical portion 58, the first member 52, and the second and third members 53 and 54 are as a whole, a strip-shaped member extending straight with a shape of a thin two-pronged fork. In this case, the first member 52 corresponds to the handle of the fork, and the second and third members 53 and 54 connected to each other by interconnecting portion 55, correspond to two prongs of the fork. Also, a long and thin aperture 56 is formed between the second and third members 533, 54. In a state before forming the cylindrical portion 58 by bending the plate, this aperture 56 extends to be in registration with the line of extension of the first member 52, and is rectangular that is wider than the first member 52.

By bending a portion of the first member 52 adjacent to the interconnecting portion 55, and portions of the second and third members 53, 54 adjacent to the interconnecting portion 55 into a circular arc shape, the cylindrical portion 58 is formed. The first, second and third members 52, 53 and 54 form a continuous circular arc. This arc is formed so that the curvature of the first member 52 and the curvature of the second and third members 53, 54 are substantially the same.

Although the circular arc is formed so that the curvature of the first member 52 and the curvature of the second and third members 53, 54 are substantially the same, the circular arc may be formed so that the curvature of the first member 52 is larger than that of the second and third members 53, 54, or the curvature of the first member 52 maybe smaller than that of the second and third members 53, 54. The circular arc is formed so that a portion of the first member 52 may be located within the aperture 56. Therefore, the cylindrical portion 58 is formed so that its elevational view presents almost a perfect circle. The central angle of the arc formed by the first member 52 and the second and third members 53, 54 is 360 degrees or more. The first member 52 and the second and third members 53, 54 are bent and rolled for more than one complete revolution so as to form the cylindrical portion 58 shown.

As illustrated in the drawings, the central angle of the arc formed by the first member 52 and the second and third members 53, 54 is approximately 540 degrees. The series of strips that include the first member 52 and the second and third members 53, 54 are bent and rolled for approximately one complete and a half revolution so as to form the cylindrical portion 58. The central angle of the arc is not limited to that shown example in the drawings, and may be any angle as long as it is 360 degrees or more.

The projecting portion 59 is formed in the first member 52 adjacent to the opposite side of the interconnecting portion 55, or in other words, an area near the free end. The first member 52 includes a first flat plate portion 52*a* extending towards the tangent from the peripheral surface of the cylindrical portion 58, and the projecting portion 59 is connected to the first flat plate portion 52*a*. The first flat plate portion 52*a* extends approximately horizontally and is approximately parallel to the base 57.

The projecting portion 59 is connected to the first plate portion 52*a* via a first curved portion 52*b* which is curved gently, and includes a first slope portion 59*b* extending obliquely downward to an external side of the cylindrical portion 58 (to the right of FIGS. 3 and 4) from the first flat plate portion 52*a*, the contact portion 59*a* serving as an end portion of the projecting portion 59 which is connected to the lower end of the first slope portion 59*b*, a second slope portion 59*c* extending obliquely downward towards the inside of the cylindrical portion 58 (to the left side of FIGS. 3 and 4) from the contact portion 59*a*, and a free end portion 59*d* which is the extreme end of the second slope portion 59*c* and a free end of the terminal 51. Note that the contact portion 59*a* is curved, and the surface on the external side thereof (the right of FIGS. 3 and 4) is a smoothly curved surface.

The interconnecting portions 60 are formed in the ends of the second and third members 53 and 54 on the opposite side of the interconnecting portion 55, and the second and third members 53 and 54 are integrally connected to the base portion 57 via the interconnecting portions 60. The interconnecting portions 60 include second flat plate portions 53*b* and 54*b* extending to the tangible direction from the peripheral surface of the cylindrical portion 58, third flat plate portions 53*c* and 54*c* extending to the external side of the cylindrical portion 58 from the base 57, and interconnecting curved portions 53*a* and 54*a* which are curved at approximately 180 degrees and interconnect the second flat plate portions 53*b* and 54*b* and the third flat plate portions 53*c* and 54*c*. The side view (FIG. 5A) of the interconnecting portions 60 is approximately U-letter shape. The free end portion 59*d* of the projecting portion 59 exists within a space defined between the interconnecting curved portions 53*a* and 54*a* on laterally opposite sides.

Further, the base 57 is a rectangular flat plate, the third flat plate portions 53*c* and 54*c* are connected to one end side of the base portion 57, and tail portion 57*a* is connected to the other end side. The tail portion 57*a* is connected to a connection pad of the electronic equipment such as by soldering. A plurality of mounting projections 57*b* may be formed on both sides of the base 57. The terminals 51 mounted within the accommodating recessed portions 13 of the housing 11 are firmly secured as the mounting projections 57*b* grasp the inner walls of the accommodating recessed portions 13.

Figure 5B:
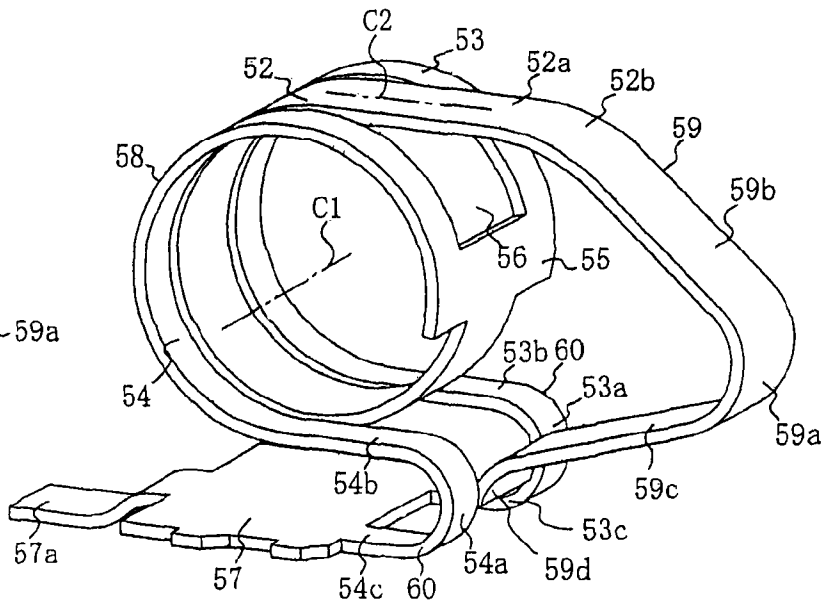
FIGS. 5A and 5B are views illustrating an initial state of the terminal.
Figure 5A:
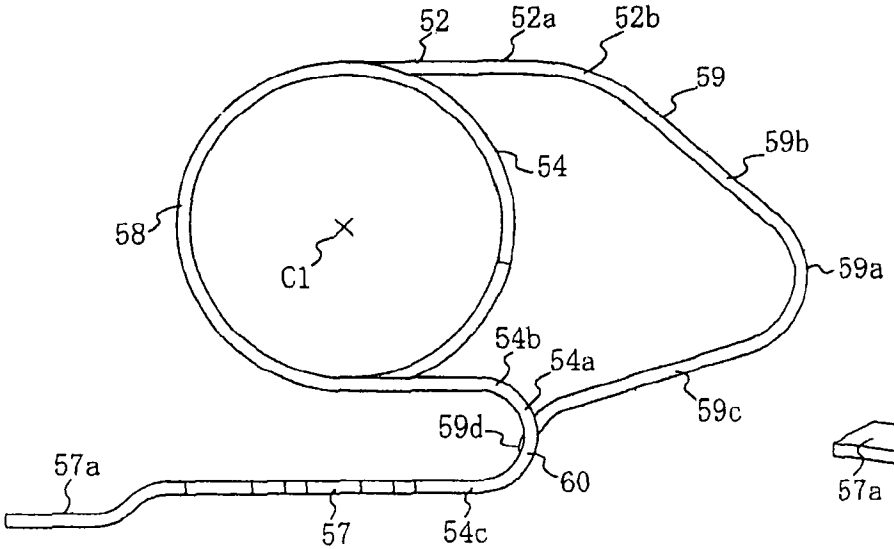

The operation of the terminal 51 is now described. in the initial state where the opposite-side device 101 is not connected to the connector 1, and the contact portion 59*a* does not in contact with the terminal 151 (FIG. 2), the terminal 51 takes a shape as best shown in FIGS. 5A and 5B. In this case, the cylindrical portion 58 holds a shape close to a perfect circle, the second flat plate portions 53*b* and 54*b* are approximately parallel to the base portion 57 and extend in an approximately horizontal direction, the first flat plate portion 52*a* is approximately parallel to the base 57 and extends in an approximately horizontal direction, and the free end portion 59*d* enters and exists in a space defined between the interconnecting curved portions 53*a* and 54*a*.

When viewed from the side of the cylindrical portion 58, the contact portion 59*a* is located closer to the base 57 in comparison with the location of the central axis C1 of the cylindrical portion 58 in an fore and aft direction (the right and left direction in FIGS. 5A and 6A), in other words, the contact potion 59*a* is formed to occupy a position located on a side lower than the position of the central axis C1.

Figure 6B:
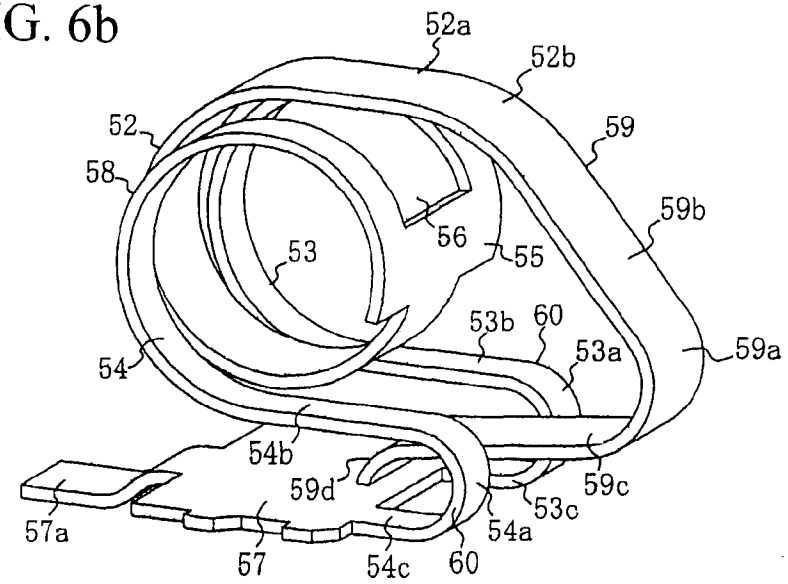
FIGS. 6A and 6B are views illustrating a state after displacement of the terminal; and, FIG. 7 is a perspective view illustrating a conventional terminal.

Next, from the state depicted in FIG. 2, the opposite-side device 101 is moved towards the connector 1, allowing the opposite-side device 101 to be connected to the connector 1. In this case, since the opposite-side terminal 151 of the opposite-side device 101 is pressed against the contact portion 59*a* of the projecting portion 59 projecting towards the front from the housing 11, the contact portion 59*a* receives a biasing force towards the cylindrical portion 58, that is, to the backwards (to the left side in FIG. 5A) from the battery terminal 151. Furthermore, since the contact portion 59*a* is formed to be situated lower than the central axis C1, once the contact portion 59*a* receives the biasing force from the battery terminal 151, the first curved portion 52*a* is deformed and displaced downward as well. As a result, the terminal 51 is elastically deformed, and changed into the shape illustrated in FIGS. 6A and 6B, and the contact portion 59*a* is displaced towards the backward and downward so as to be directed toward the cylindrical portion 58.

Figure 6A:
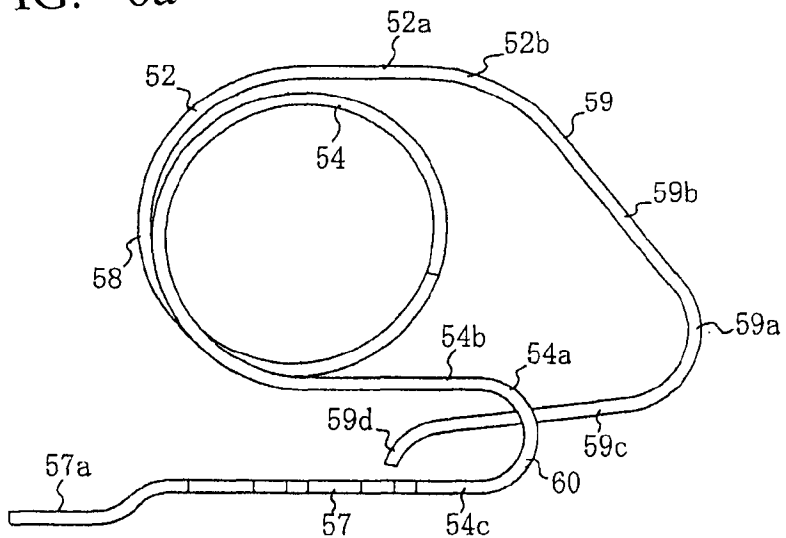
Figure 7:
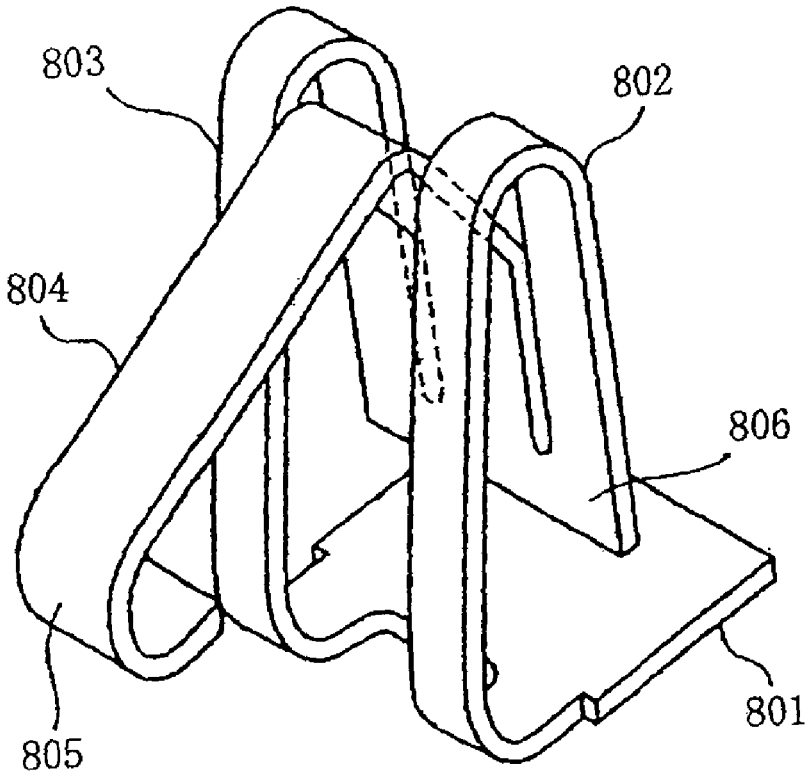

When receiving the biasing force to the back from the battery terminal 151, the first member 52, and the second and third members 53 and 54, and the projecting portion 59 are deformed. This means that the circular arc portion of the first member 52 is displaced backward while being deformed into a slightly irregular circle, and, in association with this, the contact portion 59*a* is displaced backward as the circular arc portions of the second and third members 53 and 54 in the vicinity of the interconnecting portion 55 are also displaced backward while the curvatures thereof are reduced, and further, the contact portion 59*a* is displaced backward and downward because the first curved portion 52*a* is deformed while being bent downward and the projecting portion 59 is displaced backward and downward. The cylindrical portion 58 becomes a slightly irregular circle in stead of a perfect circle, and the first curved portion 52*a* is also deformed as shown in FIG. 6A. The main deformation occurs in the cylindrical portion 58, and the contact portion 59*a* is displaced downward only slightly even if the contact portion 59*a* is largely displaced backward, in other words, the amount of horizontal displacement of the contact portion 59*a* is large, and the amount of vertical displacement is small.

When reducing the size of the connector 1 width wise or reducing the thickness of the battery device 101, since the contact portion 59*a* is formed at a position lower than the central axis C1, any biasing force exhibited by the battery 151 is successfully absorbed at two points by displacements of the cylindrical portion 58 and the projecting portion 59. The connector 1 and the battery 101 may be easily reduced in the size thereof, respectively.

The terminal 51 in which the contact portion 59*a* is formed at an equivalent location to the central axis C1 may be used, and although the cylindrical portion 58 receives a biasing force from the battery terminal 151 and is deformed elastically, and the contact portion 59*a* is displaced downward only, the contact portion 59*a* is not deformed downward. This is because the biasing force that is applied to the contact portion 59*a* generates so as to transmit in only a direction towards the central axis C1. In this case, because it is not necessary to consider vertical displacement, the size of the connector 1 can be reduced in the thickness direction.

A portion of the first member 52 is formed to be positioned in the aperture 56, and the terminal 51 is formed approximately symmetrically relative to the central line C2 in the horizontal direction of the first member 52, the contact portion 59 is prevented from being displaced in directions other than the horizontal direction and the vertical direction, and the contact portion 59 is smoothly displaced in the horizontal and vertical directions.

Although the second and third members 53, 54 are formed to have approximately the same width, even if the second and third members 53 and 54 are formed to have different widths from one another, the contact portion 59*a* is still prevented from being displaced in directions other than the horizontal direction and the vertical direction as long as a portion of the first member 52 is formed to be placed in the aperture 56, and therefore the contact portion 59*a* can be smoothly displaced in the horizontal direction and the vertical direction.

Therefore, the free end portion 59*d* of the projecting portion 59 can be displaced backward without interfering with the base 57. The entire projecting portion 59 is smoothly displaced without interfering with other areas of the base portion 57 and the like, and a biasing force applied by the battery terminal 151 is absorbed flexibly, and thus no unnecessary force is applied to the entire connector 1.

The amount of vertical displacement of the contact portion 59*a* is small, even if the dimension of the battery terminal 151 is small vertically, and the contact portion 59*a* does not miss the battery terminal 151, ensuring that the contact between the contact portion 59*a* and the battery terminal 151 is maintained.

The terminal receiving portion 14 is formed in the housing 11, even if the biasing force applied from the battery terminal 151 is large and the projecting portion 59 is greatly displaced downward, the projecting portion 59 comes into contact with the terminal receiving portion 14, and the projecting portion 59 is prevented from being excessively displaced downward, ensuring that the contact of the contact portion 59*a* with the battery terminal 151 is reliably maintained. If a biasing force is still applied even after the terminal 51 has come into contact with the terminal receiving portion 14, the cylindrical portion 58 receives the force and is displaced. Therefore, the terminal 51 is elastically deformed without having permanent plastic deformation, thus enabling the terminal 51 to maintain reliable contact with the opposite-side terminal 151.

Further, since the length of members forming the cylindrical portion 58 which serves as a mainly deformed portion is long, in other words, the continuous circular arc formed by the first member 52 and the second and third members 53 and 54 is long, the spring length becomes large, and therefore the amount of displacement of the contact portion 59*a* horizontally in large. The tolerance of relative positions of contact portion 59*a* and the battery terminal 151 is large, and, even if relative positions of the contact portion 59*a* and the battery terminal 151 are largely changed due to dimensional errors of the body 111 of the opposite-side device 101, dimensional errors of the electronic equipment mounting, or an error in attaching the electronic equipment to the connector 1, the contact with the battery terminal 151 is maintained as the contact portion 59*a* displaces widely.

The cylindrical portion 58, has a large spring length, even if the contact portion 59*a* is greatly displaced horizontally and the amount of displacement of the outer diameter and that of the position of the cylindrical portion 58 are small. Occurrence of either the deformation of the first flat plate portion 52*a* or that of the interconnecting portions 60 is the smallest. The dimension of the terminal 51 hardly changes vertically and horizontally, and the dimensions of the accommodating recessed portions 13 may be reduced vertically and horizontally, thus reducing the size of the connector 1. Also, since the spring length is large, any force applied to the cylindrical portion 58 and other portions are dispersed, preventing damages and plastic deformation of the terminal 51.

A portion of the first member 52 is located in the gap portion 56 between the second and third members 53 and 54, the terminal 51 has a symmetrical shape relative to the width direction (a direction perpendicular to the drawing in FIG. 5A), and the first member 52 is located at the center of the terminal 51 in the width direction. Therefore, even if the contact portion 59*a* receives a backward biasing force applied from the battery terminal 151, no stress component or bending movement relative to the width of the terminal 51 is generated. As a result, excessive force is not applied to the entire terminal 51, and therefore a no damage and no plastic deformation occurs in the terminal 51. The terminal 51 is hardly displaced widthwise and the dimensions of the accommodating recessed portions 13 are reduced widthwise, and the size of the connector 1 can be reduced.

The projecting portion 59 of the first member 52 may include a slit longitudinal. By providing the slit, the projecting portion 59 is divided into a plurality of portions widthwise, and the contact portion 59*a* is also divided into a plurality of portions widthwise. Since a plurality of contact portions 59*a* contact the battery terminal 151, the terminal 51 ensure that the connection with the battery terminal 151 is maintained.

The terminal 51 contains a base portion 57 for attachment to a connector 1, a cylindrical portion 58 connected to the base portion 57, and a projecting portion 59 projecting toward one side of the cylindrical portion 58 and a contact portion 59*a*. The cylindrical portion 58 includes a strip-shaped first member 52, as well as strip-shaped second member 53 and third member 54 which are connected to one end of the first member 52 and parallel to each other. The first, second, and the third members 52, 53 and 54 form a continuous circular arc with an central angle of 360 degrees or more and a portion of the first member 52 is located between the second member 53 and the third member 54, and the projecting portion 59 is a portion of the first member 52 adjacent to an free end thereof.

When the contact portion 59*a* receives a biasing force applied by the opposite-side terminal 151, the cylindrical portion 58 is elastically deformed, and the contact portion 59*a* is displaced backward. Therefore, the amount of displacement of the contact portion 59*a* in the horizontal direction becomes large, and is small in the vertical direction. Hence, even if the battery terminal 151 is small, contact between the terminal 51 and the battery terminal 151 is reliably maintained. Since an amount of displacement of the external shape of the entire terminal 51 is small, the space exclusively occupied by the terminal 51 is small, so the size of the connector 1 is reduced.

The present invention is not limited to the above-described embodiments, and may be changed in various ways based on the gist of the present invention, and these changes are not eliminated from the scope of the present invention.

What is claimed is:

1. A connector terminal, comprising: a base for attachment to a connector;

a cylindrical portion connected to the base; and a projecting portion projecting toward one side of the cylindrical portion and including a contact portion, wherein the cylindrical portion includes strip-shaped first member, second member and third members, the second and third members being connected to one end of the first member and parallel to each other;

said first member, second member and the third members forming a continuous circular arc with a central angle of 360 degrees or more;

a portion of the first member being located between said second and the third members; and said projecting portion including a portion of the first member adjacent to an free end thereof;

wherein said first member includes a longitudinal slit extending in the projecting portion, and the contact portion is divided in a widthwise of said connector terminal.

2. The connector terminal according to claim 1, wherein said contact portion receives a biasing force exhibited by an opposite-side device terminal toward said cylindrical portion.

3. The connector terminal according to claim 1, wherein said contact portion is displaced by elastic deformation of said cylindrical portion when the contact portion receives a biasing force exhibited by said opposite-side device terminal.

4. The connector terminal according to claim 3, wherein said contact portion is provided to displace toward said cylindrical portion.

5. The connector terminal according to claim 4, wherein a straight line which indicates a direction of the biasing force that said contact portion receives from said opposite-side device terminal is located closer to said base than a central axis of said cylindrical portion.

6. The connector terminal according to claim 4, wherein a straight line which indicates a direction of the biasing force that said contact portion receives from said opposite-side device terminal passes a central axis of said cylindrical portion.

7. The connector terminal according to claim 1, wherein said first member is located at a center of the connector terminal in a widthwise direction.

8. The connector terminal according to claim 1, wherein said first member, the second member, and third member are connected together via an interconnecting portion, and have a shape of two-pronged fork in a state before forming said circular arc.

9. A connector, comprising:

a connector terminal including:

a base for attachment to the connector;

a cylindrical portion connected to the base;

a projecting portion projecting toward one side of the cylindrical portion and including a contact portion thereof; and a housing supporting the connector terminal, wherein the cylindrical portion comprises a strip-shaped first member, and strip-shaped second and third members which are connected to one end of the first member and parallel to each other, said first through third members forming a continuous circular arc with a central angle of 360 degrees or more, a portion of said first member is located between said second member and said third member, the projecting portion is a portion of said first member located adjacent to a free end thereof, the housing including an accommodating recessed portion receiving therein said connector terminal, and the accommodating recessed portion accommodates one or more of said connector terminals;

wherein said first member includes a longitudinal slit extending in the projecting portion, and the contact portion is divided in a widthwise of said connector terminal.

10. The connector according to claim 9, wherein said housing includes an opening communicating with said accommodating recessed portion, and the contact portion projects outwards from said opening.

11. The connector according to claim 9, wherein:

said contact portion is displaced due to elastic deformation of said cylindrical portion when said contact portion receives a biasing force exhibited by an opposite-side terminal, and said housing includes a terminal receiving portion which contacts said displaced contact portion.

* * * * *